US010774485B2

(12) United States Patent
Watkins et al.

(10) Patent No.: US 10,774,485 B2
(45) Date of Patent: Sep. 15, 2020

(54) PRE-FILLED ADHESIVE PAVEMENT MARKERS

(71) Applicants: Anthony Watkins, Wandana Heights (AU); Darren Brown, Parkerville (AU)

(72) Inventors: Anthony Watkins, Wandana Heights (AU); Darren Brown, Parkerville (AU)

( * ) Notice: Subject to any disclaimer, the term of this patent is extended or adjusted under 35 U.S.C. 154(b) by 0 days.

(21) Appl. No.: 16/325,443

(22) PCT Filed: Aug. 15, 2017

(86) PCT No.: PCT/AU2017/050869

§ 371 (c)(1),
(2) Date: Feb. 14, 2019

(87) PCT Pub. No.: WO2018/032050

PCT Pub. Date: Feb. 22, 2018

(65) Prior Publication Data

US 2019/0368139 A1 Dec. 5, 2019

(30) Foreign Application Priority Data

Aug. 15, 2016 (AU) ..... 2016903222

(51) Int. Cl.
*E01F 9/00* (2016.01)
*E01F 9/553* (2016.01)
*E01F 9/512* (2016.01)

(52) U.S. Cl.
CPC ..... *E01F 9/553* (2016.02); *E01F 9/512* (2016.02)

(58) Field of Classification Search
CPC ..... E01F 9/512; E01F 9/553
USPC ..... 404/12–16
See application file for complete search history.

(56) References Cited

U.S. PATENT DOCUMENTS 3,784,279 A 1/1974 Hedgewick
4,136,991 A * 1/1979 Clark ..... E01F 9/553 404/15
4,340,319 A * 7/1982 Johnson, Jr. ..... E01F 9/553 359/551
4,717,281 A 1/1988 Shepherd et al.
5,078,538 A * 1/1992 Montalbano ..... E01F 9/553 404/12
5,108,217 A 4/1992 Bloom
5,540,517 A * 7/1996 Varosh ..... C06B 33/14 156/71
5,667,334 A * 9/1997 Boyce ..... E01F 9/553 404/15
6,079,899 A * 6/2000 Green ..... E01F 9/553 116/63 P
6,109,821 A * 8/2000 Montalbano ..... E01F 9/553 116/63 R
6,126,360 A 10/2000 May et al.
(Continued)

FOREIGN PATENT DOCUMENTS

GB 2140850 A 12/1984

*Primary Examiner* — Raymond W Addie
(74) *Attorney, Agent, or Firm* — David Guerra

(57) ABSTRACT

A pre-filled adhesive pavement marker having a body with downwardly facing openings that are pre-filled with an adhesive. An adhesive pad including an adhesive can be provided on a surface of a pavement. The pre-filled adhesive pavement marker can be attached to the adhesive pad to thereby adhere the pre-filled pavement marker to the surface of the pavement.

19 Claims, 5 Drawing Sheets

(56) References Cited

U.S. PATENT DOCUMENTS 7,413,373 B1 * 8/2008 Attar ..... E01F 9/553
404/12

* cited by examiner

PRE-FILLED ADHESIVE PAVEMENT MARKERS

FIELD

The present invention relates to pre-filled adhesive pavement markers and a related method of adhering them to pavement or roadway surfaces.

BACKGROUND

Pavement and road markings and devices are fixed onto roads, pathways, runways and service areas for a variety of reasons. For example, raised pavement markings (RPMs), raised reflective pavement markings (RRPMs) and other tactile markings are often used to guide and warn road users or delineate reserved areas.

RRPMs are advantageous in that they assist warn and guide road users with audible and steering vibration feedback to the driver and they function in inclement weather for example when a roadway is heavily sheeted in water or fog.

Bituminous road surfaces are made from composite materials containing rock and emulsion. Road devices are often anchored in place using bitumen-based adhesives or bonding agents, which have the same properties as the emulsion used in the road surface. To install the device, a block of adhesive, or pre-formed adhesive pad, is firstly heated and then applied onto the road surface. The device is then placed onto the adhesive while still hot and optionally rotated and/or moved until the device is in the correct orientation and position. The adhesive is then left to cool and set hard to anchor the device in place.

The connection between the device and the road surface can become weak or vulnerable to breakage over time, particularly when the road and device have been exposed to repeated fluctuations in temperature. Bitumen expands and softens in warm temperatures and contracts and hardens in cold temperatures. Changes in ambient temperature, therefore, lead to tension in the road surface and in the adhesive medium connecting the devices to the road surface. Road devices do not expand or contract with the road surface to which they are connected to accommodate such changes.

The difference between the surface tensions in an inflexible solid-state road device, the flexible adhesive pad and the as constructed bitumous road surface is, therefore, constantly changing. Prolonged exposure to temperature fluctuations as a result of daily and climatic weather changes eventually leads to breakage of the connection between the device and the surface causing the device to disconnect from the surface. Impacts and wear caused by wheels of traffic exacerbates the weakening of the connection. Road devices that separate, come loose and break away from their mountings can be hazardous, particularly in heavy and fast-flowing traffic conditions. Devices can become airborne causing damage to property and personal injury and, in extreme cases, can have fatal consequences.

Great improvements have been made in the manufacture of RRPMs over time such as their Impact strength, ultraviolet protection and reflective properties. RRPMs are commonly manufactured from glass, aluminium or specially formed hardened plastics or polymers and are therefore inflexible. The connection of RRPMs to their adhesive pad and the roadway surface has not evolved nor has it been improved in accordance with road traffic safety or RRPM manufacture. RRPMs are inflexible and they are installed onto a flexible adhesive pad and this connection releases under climatic and road traffic forces.

The associated costs in the replacement maintenance and reinstatement of safety delineators due to their adhesive failure rate is a significant problem in the global road marking industry.

A need therefore exists for improved solutions for adhering pavement markers to pavement or roadway surfaces.

SUMMARY

A method, comprising:

providing a pre-filled adhesive pavement marker having a body with downwardly facing openings that are pre-filled with an adhesive;

providing an adhesive pad of the adhesive on a surface of a pavement;

attaching the pre-filled adhesive pavement marker to the adhesive pad to thereby adhere the pre-filled pavement marker to the surface of the pavement.

The adhesive used to the pre-fill the pre-filled adhesive pavement marker and the adhesive used in the adhesive pad may comprise the same adhesive so that like-for-like adhesion is provided between the pre-filled adhesive pavement marker and the surface of the pavement.

The adhesive may comprise bitumen or epoxy.

When the adhesive comprises bitumen, the adhesive pad may be heated before attachment of the pre-filled adhesive pavement marker.

When the adhesive comprises bitumen, the bitumen used to pre-fill the pre-filled adhesive pavement marker may comprise a low softening point bitumen, and the bitumen used in the adhesive pad may comprise a high softening point bitumen.

The pre-filled adhesive pavement marker may be pre-filled with the low softening point bitumen heated to a temperature between around 250° C. and around 270 CC, for example, around 260° C. This temperature is required to ensure that the viscosity of the bitumen adhesive fills all cavities within the marker and that the bitumen adhesive etches into the markers structural surface which ensures a strong internal bonding between the bitumen adhesive filler and the marker body.

The adhesive pad may comprise the high softening point bitumen heated to a temperature between around 210° C. and around 220° C., for example, around 215° C.

The pre-filled adhesive pavement marker may comprise any one of a raised pavement marking, a raised reflective pavement marking, and a road stud.

The present invention also provides a pre-filled adhesive pavement marker having a body with downwardly facing openings that are pre-filled with an adhesive.

The adhesive may comprise bitumen or epoxy.

The downwardly facing openings may have a depth no greater than so as to allow the downwardly facing openings to completely pre-fill with the adhesive before the pre-filled adhesive pavement marker is adhered to a surface of a pavement.

The downwardly facing openings may be defined by downwardly projecting ribs formed inside the body.

The downwardly projecting ribs may be formed in any one of a cross-hatch pattern, a mesh pattern, and a waffle pattern.

The body may comprise downwardly projecting peripheral portions, and the downwardly projecting ribs may project downwardly between the downwardly projecting peripheral portions.

The downwardly projecting ribs may have a depth less than the depth of the downwardly projecting peripheral portions.

The body and the downwardly facing openings may be formed as a moulding of a resilient plastics material.

The downwardly facing openings may be pre-filled with the adhesive after moulding and before the pre-filled adhesive pavement marker is adhered to an adhesive pad on a surface of a pavement.

The present invention further provides a surface of a pavement comprising a pavement marker adhered thereto by the method described above.

BRIEF DESCRIPTION OF DRAWINGS

Embodiments of the invention will now be described by way of example only with reference to the accompanying drawings, in which.

DESCRIPTION OF EMBODIMENTS

Figure 1:
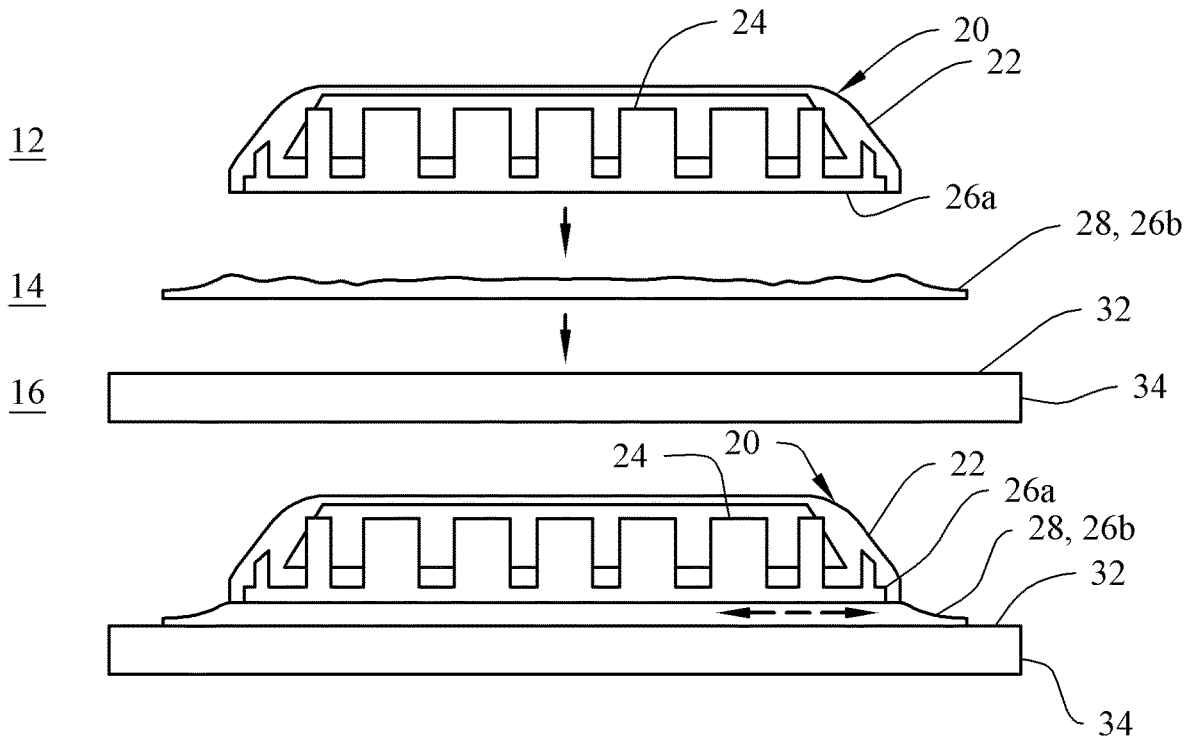
FIG. 1 is a schematic flow diagram of a method of adhering a pre-filled adhesive pavement marker to a surface of a pavement or roadway according to an embodiment of the present invention.

FIG. 1 is a schematic flow diagram of a method 10 of adhering a pre-filled adhesive pavement marker 20 to a surface 32 of a pavement or roadway 34 according to an embodiment of the present invention. The method 10 starts at step 12 by providing the pre-filled adhesive pavement marker 20 having a body 22 with downwardly facing openings 24 that are pre-filled with an adhesive 26. The pre-filled adhesive pavement marker 20 may comprise any one of a raised pavement marking, a raised reflective pavement marking, and a road stud.

Next, at step 14, an adhesive pad 28 of the adhesive 26 is provided on a surface 32 of a pavement or roadway 34. The adhesive 26 used to the pre-fill the pre-filled adhesive pavement marker 20 and the adhesive 26 used in the adhesive pad 28 may comprise the same adhesive 26 so that like-for-like adhesion is provided between the pre-filled adhesive pavement marker and the surface of the pavement. The adhesive 26 may, for example, comprise bitumen or epoxy. When the adhesive 26 comprises bitumen, the like-for-like adhesion is provided between the pre-filled adhesive pavement marker and the surface of the pavement may advantageously be at least partially flexible and/or movable in response to varying climatic and impact conditions.

When the adhesive 26 comprises bitumen 26, the adhesive pad 28 may be heated before attachment of the pre-filled adhesive pavement marker 20. For example, the adhesive pad 28 may, for example, comprise a bitumen block 28 that is melted in a hot melt kettle and poured onto the surface 32, or bitumen sheet 28 that is blowtorched onto the surface 32.

A bitumen based adhesive is used as an anchoring point to the road surface to produce a flexible connection point that is compatible with the bitumous emulsion in the road. The adhesive bitumen pad is designed to behave in concert with the road and has the flexibility to harden and soften and expand and contract in conjunction with the road surface with climatic variations and changes.

When the adhesive 26 comprises bitumen, the bitumen 26 used to pre-fill the pre-filled adhesive pavement marker 20 may comprise a low softening point bitumen **26*a*, and the bitumen 26 used in the adhesive pad may comprise a high softening point bitumen 26*b*. For example, the pre-filled adhesive pavement marker 20 may be pre-filled with the low softening point bitumen 26*a* heated to a temperature between around 250° C. and around 270° C., for example, around 260° C. The adhesive pad 28 may comprise the high softening point bitumen 26*b*** heated to a temperature between around 210° C. and around 220° C., for example, around 215° C.

The method 10 ends at step 16 by attaching the pre-filled pavement marker 20 to the adhesive pad 28 to thereby adhere the pre-filled pavement marker 20 to the surface 32 of the pavement or roadway 34.

Figure 2:
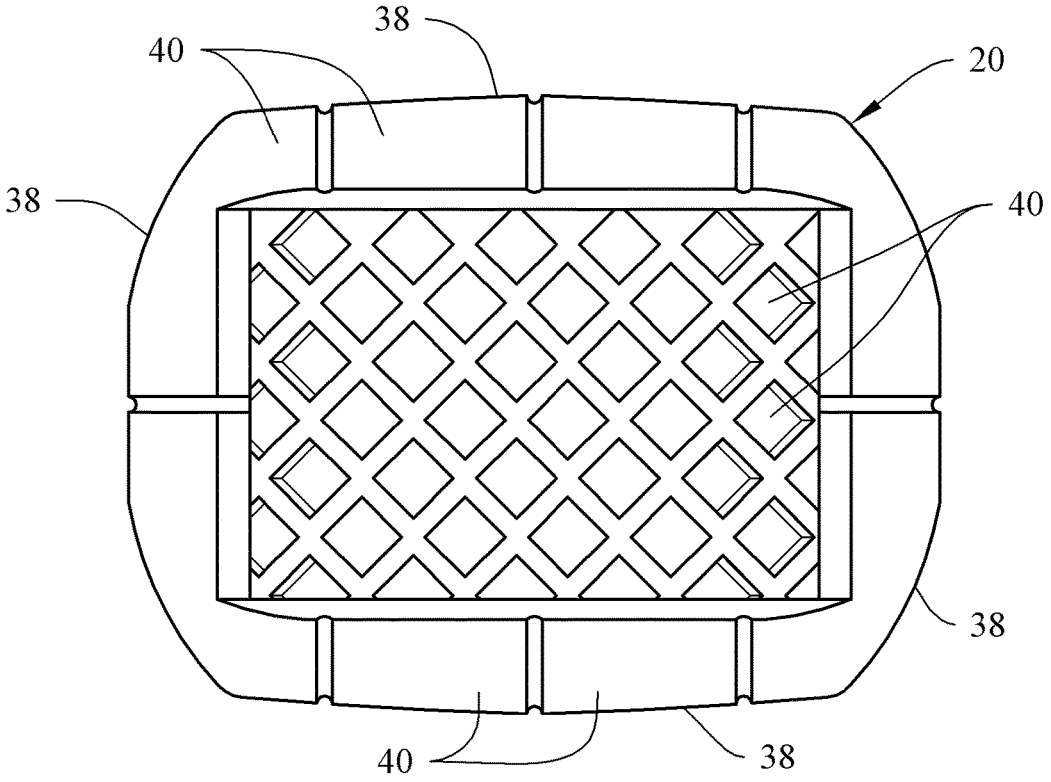
FIG. 2 is a photographic bottom view of a pre-filled adhesive pavement marker according to an embodiment of the present invention showing the open cavities that will be filled with bitumen adhesive prior to installation.
Figure 3:
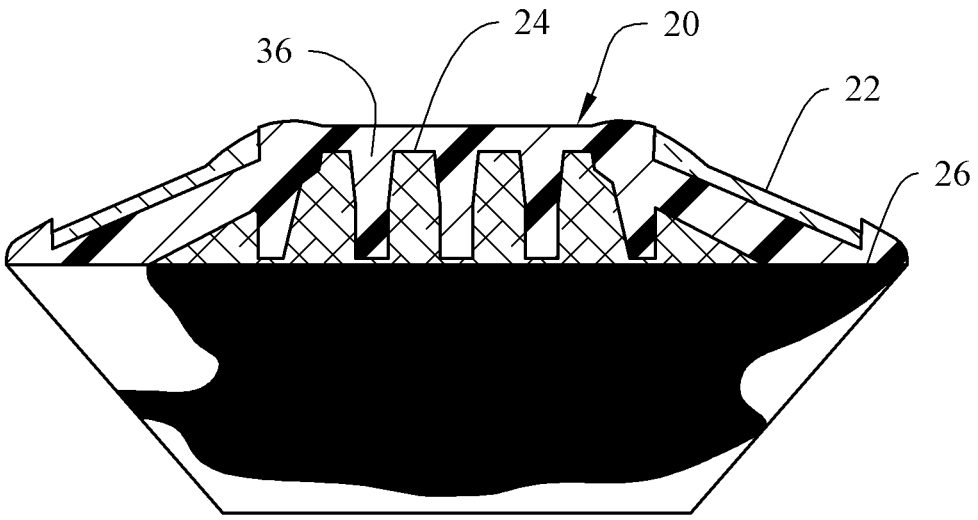
FIGS. 3 and 4 are photographic cross-sectional views of the pre-filled adhesive pavement marker.
Figure 4:
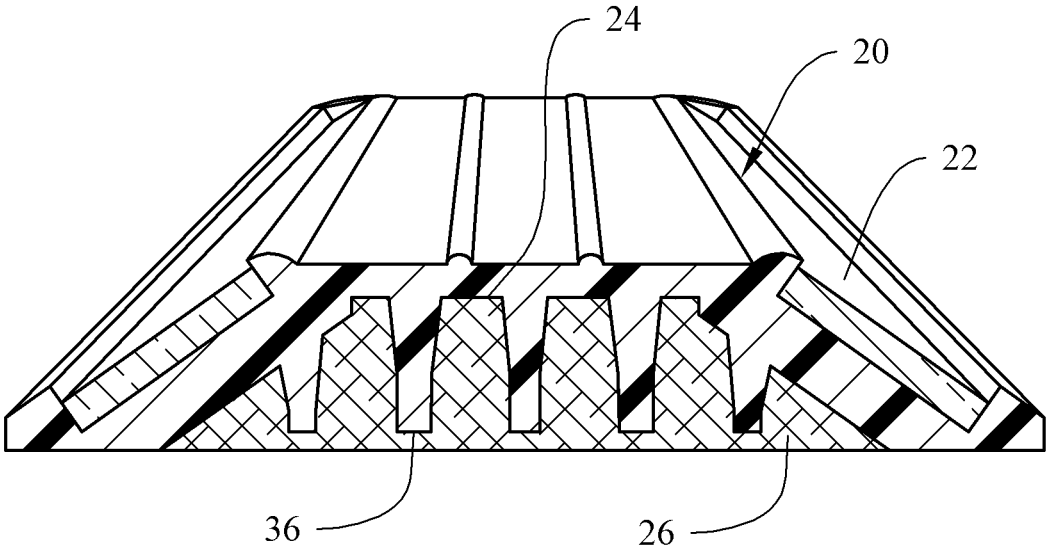

Referring to FIGS. 2 to 4, a pre-filled adhesive pavement marker 20 according to one embodiment of the present invention comprises a body 22 with downwardly facing openings 24 that are pre-filled with an adhesive 26. The adhesive 26 may comprise bitumen.

The downwardly facing openings 24 may have a depth no greater than so as to allow the downwardly facing openings 24 to completely pre-fill with the adhesive 26 before the pre-filled adhesive pavement marker 20 is adhered to the surface 32 of the pavement or roadway 34.

The downwardly facing openings 24 may be defined by downwardly projecting ribs 36 formed inside the body 22. The downwardly projecting ribs 36 may be formed in any one of a cross-hatch pattern, a mesh pattern, and a waffle pattern.

The body 22 may comprise downwardly projecting peripheral portions 38, and the downwardly projecting ribs 36 may project downwardly between the downwardly projecting peripheral portions 38. The downwardly projecting ribs 36 may have a depth less than the depth of the downwardly projecting peripheral portions 38. The downwardly projecting peripheral portions 38 may define a generally rectangular recess. The adhesive 26 may pre-fill the generally rectangular recess up to and including the corners of generally rectangular recess to form a pre-filled base pad of the adhesive below the pre-filled downwardly facing openings 24. Semi-circular and linear grooves 40 may be formed in the downwardly projecting peripheral portions 38 to provide locating surfaces for the adhesive pad 28.

The body 22 and the downwardly facing openings 24 may be formed as a moulding of a resilient plastics material. The downwardly facing openings 24 may be pre-filled with the adhesive 26 after moulding and before the pre-filled adhesive pavement marker 20 is adhered to the surface 32 of the pavement or roadway 34.

The invention will now be described in more detail, by way of illustration only, with respect to the following example. The example is intended to serve to illustrate this invention, and should not be construed as limiting the generality of the disclosure of the description throughout this specification.

EXAMPLE

Figure 5:
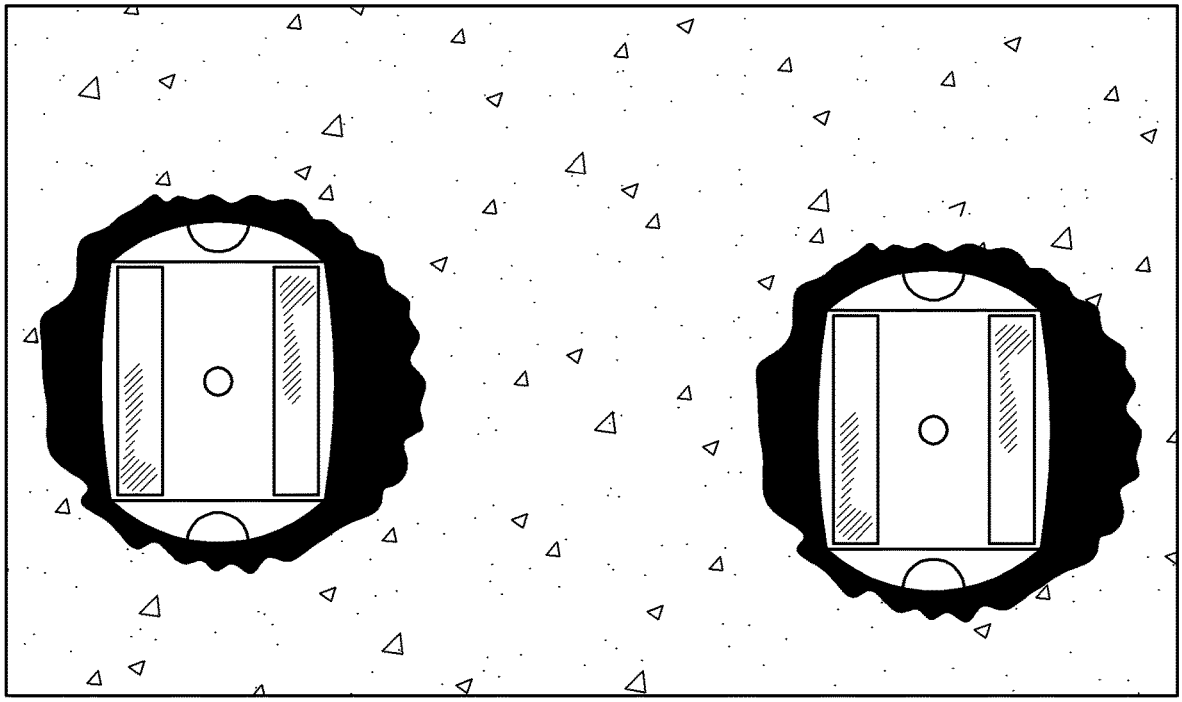
FIG. 5 is a photograph of pre-filled adhesive pavement markers adhered to a roadway surface.

FIG. 5 illustrates pre-filled adhesive pavement markers adhered to a surface of a roadway according to the method described above with bitumen used as the common adhesive. Conventional pavement markers (not shown) with a solid base without any adhesive pre-filling were also adhered to the same roadway surface with epoxy as the adhesive.

Figure 6:
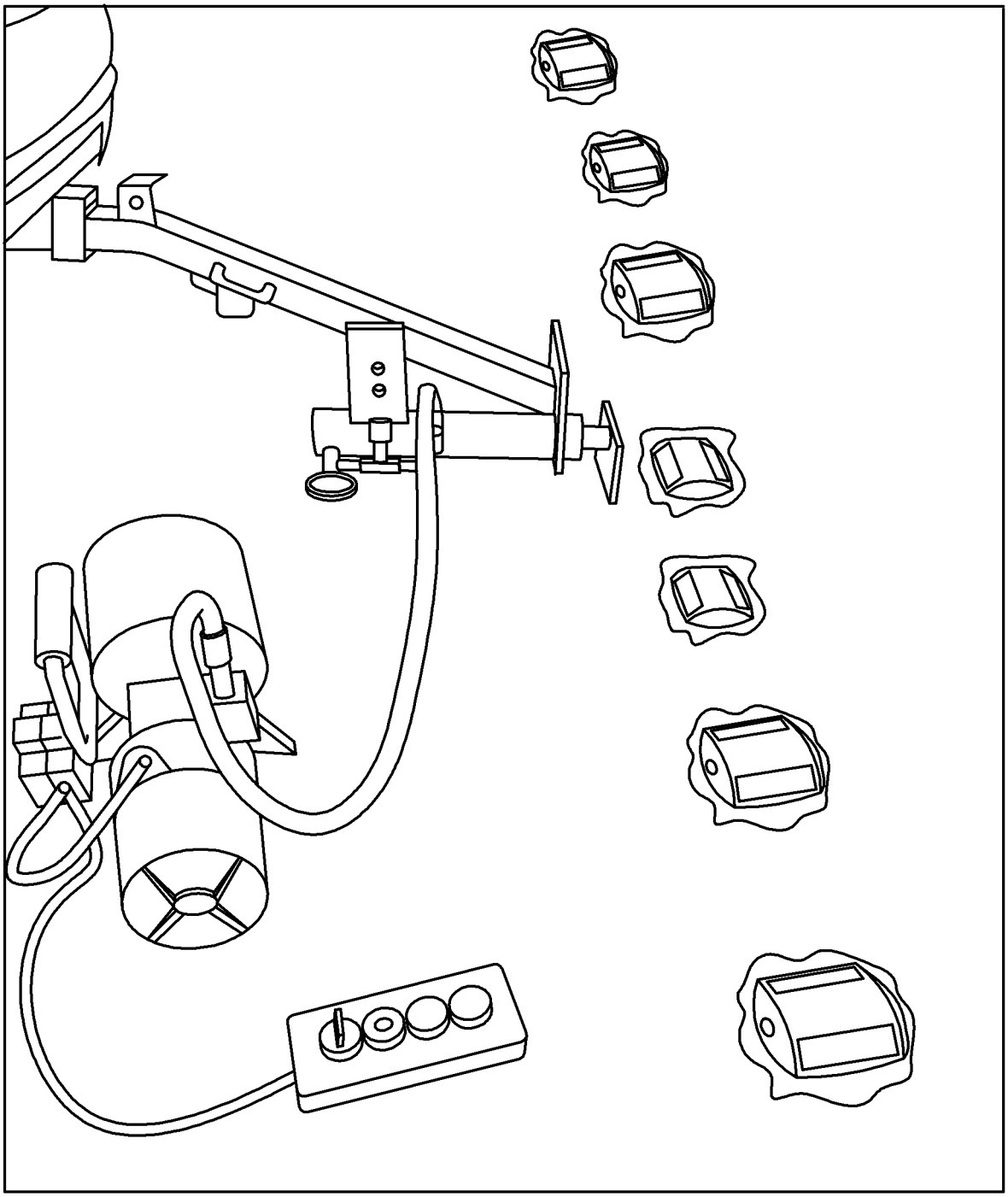
FIG. 6 is a photograph of a hydraulic ram used to separate the pre-filled adhesive pavement markers and conventional solid, unfilled pavement markers from the roadway surface.

Both the pre-filled adhesive pavement markers and the conventional solid, unfilled pavement markers were subjected to lateral shear forces from a hydraulic ram fitted with a flat plate and 20 mm chisel edge, as illustrated in FIG. 6. The lateral shear forces were applied until the pre-filled adhesive pavement markers and the conventional pavement markers separated from the roadway surface. The preparation parameters, installation parameters, and lateral forces in pounds per square inch (psi) required to separate the pre-filled adhesive pavement markers and the conventional unfilled pavement markers are set out below in Table 1 and 2 respectively.

TABLE 1

Adhesive Filled RRPM's (new model)
RRPM to Road separation shear force test results

| Preparation Parameters | | Installation Parameters | | | Result |
|---|---|---|---|---|---|
| RRPM Ref# | Bitumen Adhesive Fill Temp (° C.) | Road Temp (° C.) | Ambient Temp (° C.) | Bitumen Adhesive Temp (° C.) | Shear Force Required to Separate (PSI) |
| 1 | 220.0 | 11.0 | 13.0 | 218.00 | 1320 |
| 2 | 225.0 | 11.5 | 13.0 | 218.00 | 1650 |
| 3 | 221.0 | 11.5 | 13.0 | 218.00 | 1080 |
| 4 | 226.0 | 11.5 | 13.0 | 220.00 | 1140 |
| 5 | 228.0 | 11.0 | 13.0 | 220.00 | 1050 |
| 6 | 230.0 | 11.0 | 13.0 | 220.00 | 1200 |
| 7 | 230.0 | 11.0 | 13.0 | 220.00 | 1110 |
| 8 | 235.0 | 11.0 | 13.0 | 215.00 | 1180 |
| 9 | 235.0 | 11.0 | 13.0 | 205.00 | 1400 |
| 10 | 238.0 | 11.0 | 13.0 | 220.00 | 1350 |
| 11 | 240.0 | 11.0 | 13.0 | 220.00 | 1480 |
| 12 | 242.0 | 10.5 | 12.0 | 220.00 | 1250 |
| 13 | 245.0 | 10.0 | 12.0 | 220.00 | 1350 |
| 14 | 250.0 | 10.0 | 12.0 | 220.00 | 1180 |
| 15 | 253.0 | 10.0 | 12.0 | 218.00 | 1230 |
| 16 | 258.0 | 10.0 | 12.0 | 218.00 | 1180 |
| 17 | 262.0 | 9.5 | 11.0 | 205.00 | 1050 |
| 18 | 273.0 | 9.5 | 11.0 | 218.00 | 950 |
| 19 | 275.0 | 9.5 | 11.0 | 218.00 | 1020 |
| 20 | 280.0 | 9.5 | 11.0 | 220.00 | 1250 |
| | | | | | 1221 Avg |

TABLE 2

Unfilled/Hard Base RRPM's (old model)
RRPM to Road separation shear force test results

| | Installation Parameters | | | Result |
|---|---|---|---|---|
| RRPM Ref# | Road Temp (° C.) | Ambient Temp (° C.) | Bitumen Adhesive Temp (° C.) | Shear Force Required to Separate (PSI) |
| 21 | 9.5 | 11.0 | 220.00 | 440 |
| 22 | 9.5 | 11.0 | 220.00 | 455 |
| 23 | 9.5 | 11.0 | 220.00 | 420 |
| 24 | 9.0 | 11.0 | 220.00 | 450 |
| 25 | 9.0 | 11.0 | 218.00 | 460 |
| 26 | 9.0 | 11.0 | 218.00 | 430 |
| 27 | 9.0 | 11.0 | 218.00 | 450 |

TABLE 2-continued

Unfilled/Hard Base RRPM's (old model)
RRPM to Road separation shear force test results

| | Installation Parameters | | | Result |
|---|---|---|---|---|
| RRPM Ref# | Road Temp (° C.) | Ambient Temp (° C.) | Bitumen Adhesive Temp (° C.) | Shear Force Required to Separate (PSI) |
| 28 | 9.0 | 11.0 | 218.00 | 440 |
| 29 | 9.0 | 11.0 | 217.00 | 475 |
| 30 | 9.0 | 11.0 | 217.00 | 430 |
| 31 | 9.0 | 11.0 | 216.00 | 455 |
| 32 | 9.0 | 11.0 | 216.00 | 465 |
| 33 | 9.0 | 11.0 | 217.00 | 440 |
| 34 | 9.0 | 11.0 | 219.00 | 470 |
| 35 | 9.0 | 10.0 | 219.00 | 450 |
| 36 | 9.0 | 10.0 | 219.00 | 470 |
| 37 | 9.0 | 10.0 | 220.00 | 440 |
| 38 | 9.0 | 10.0 | 220.00 | 460 |
| 39 | 8.0 | 10.0 | 220.00 | 460 |
| 40 | 8.0 | 10.0 | 219.00 | 445 |
| | | | | 450 Avg |

Figure 7:
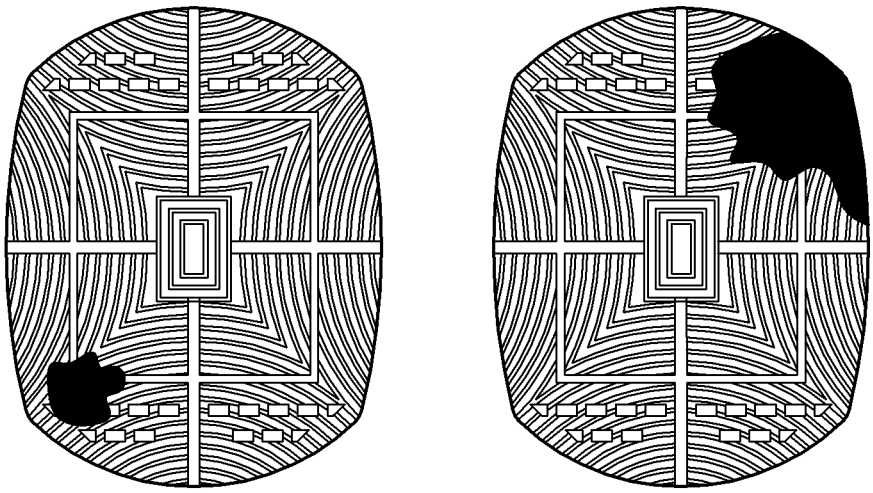
FIGS. 7 and 8 are photographs of the pre-filled adhesive pavement markers and conventional pavement markers, respectively, after separation from the roadway surface.
Figure 8:
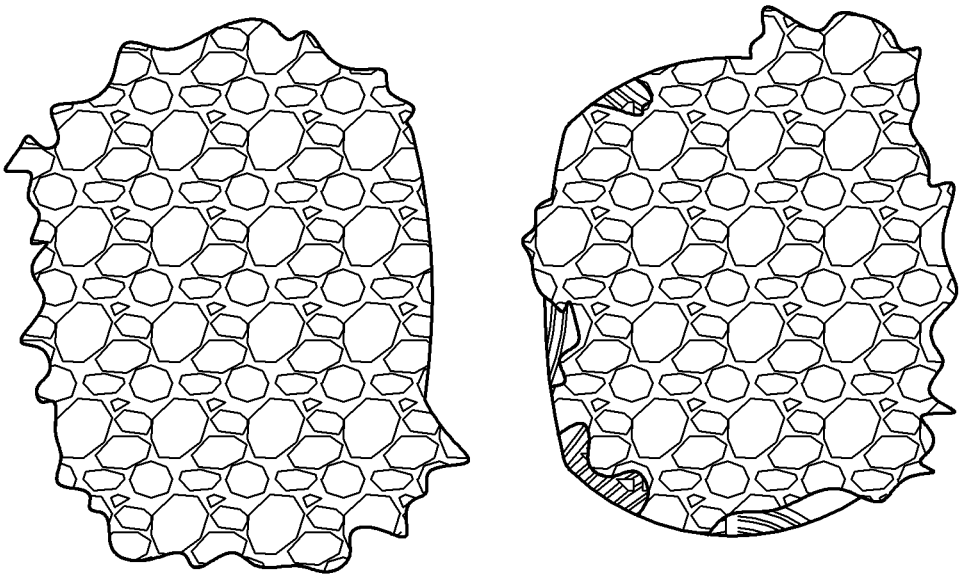

The average lateral shear force required to separate the pre-filled adhesive pavement markers from the roadway surface was 1221 psi, whereas the average force required to separate the conventional pavement markers from the same roadway surface was 450 psi. The conventional pavement markers therefore have only 37.7% of the like-for-like adhesion of the pre-filled adhesive pavement markers of the present invention. This is visually indicated in FIGS. 7 and 8 by photographs of the pre-filled adhesive pavement markers and conventional pavement markers, respectively, after separation from the roadway surface.

Embodiments of the present invention provide pre-filled adhesive pavement markers and related methods that are useful for adhering pavement markers to pavement or roadway surfaces.

For the purpose of this specification, the word "comprising" means "including but not limited to," and the word "comprises" has a corresponding meaning.

The above embodiments have been described by way of example only and modifications are possible within the scope of the claims that follow.

The invention claimed is:

1. A method, comprising:

providing a pre-filled adhesive pavement marker having a body with downwardly facing openings that are pre-filled with an adhesive;

providing an adhesive pad of comprising an adhesive on a surface of a pavement; and attaching the pre-filled adhesive pavement marker to the adhesive pad to thereby adhere the pre-filled pavement marker to the surface of the pavement;

wherein the adhesive of the pre-filled adhesive pavement marker comprises a low softening point bitumen, and the adhesive of the adhesive pad comprises a high softening point bitumen.

2. The method of claim 1, wherein the adhesive used to the pre-fill the pre-filled adhesive pavement marker and the adhesive used in the adhesive pad are configured to provide a like-for-like adhesion between the pre-filled adhesive pavement marker and the surface of the pavement.

3. The method of claim 1 further comprises the step of heating the adhesive of the adhesive pad before attachment of the pre-filled adhesive pavement marker.

4. The method of claim 1, wherein the pre-filled adhesive pavement marker comprises any one of a raised pavement marking, a raised reflective pavement marking, and a road stud.

5. The method of claim 1, wherein the pre-filled adhesive pavement marker is be pre-filled with the low softening point bitumen heated to a temperature between around 250° C. and around 270° C.

6. The method of claim 5, wherein the temperature is around 260° C.

7. The method of claim 1, wherein the adhesive pad comprises the high softening point bitumen heated to a temperature between around 210° C. and around 220° C.

8. The method of claim 7, wherein the temperature is around 215° C.

9. An adhesive marker system comprising:

A pre-filled adhesive pavement marker having a body with downwardly facing openings that are pre-filled with an adhesive; and an adhesive pad including the adhesive, comprising an adhesive pad being configured attach on a surface of a pavement;

wherein the adhesive of the pre-filled adhesive pavement marker comprises a low softening point bitumen, and the adhesive of the adhesive pad comprises a high softening point bitumen.

10. The pre-filled adhesive pavement marker of claim 9, wherein the downwardly facing openings have a depth no greater than so as to allow the downwardly facing openings to completely pre-fill with the adhesive before the pre-filled adhesive pavement marker is adhered to a surface of a pavement.

11. The pre-filled adhesive pavement marker of claim 9, wherein the downwardly facing openings are defined by downwardly projecting ribs formed inside the body.

12. The pre-filled adhesive pavement marker of claim 11, wherein the downwardly projecting ribs are formed in any one of a cross-hatch pattern, a mesh pattern, and a waffle pattern.

13. The pre-filled adhesive pavement marker of claim 11, wherein the body comprises downwardly projecting peripheral portions, and wherein the downwardly projecting ribs project downwardly between the downwardly projecting peripheral portions.

14. The pre-filled adhesive pavement marker of claim 13, wherein the downwardly projecting ribs have a depth less than the depth of the downwardly projecting peripheral portions.

15. The pre-filled adhesive pavement marker of claim 13, wherein the downwardly projecting peripheral portions define a generally rectangular recess configured to be pre-filled with the adhesive up to and including corners of the rectangular recess to form a pre-filled base pad of the adhesive below the downwardly facing openings.

16. The pre-filled adhesive pavement marker of claim 13, wherein the downwardly projecting peripheral portions define grooves configured to provide locating surfaces for the adhesive pad.

17. The pre-filled adhesive pavement marker of claim 16, wherein the grooves are one or any combination of semi-circular grooves and linear.

18. The pre-filled adhesive pavement marker of claim 9, wherein the body and the downwardly facing openings are formed as a moulding of a resilient plastics material.

19. The pre-filled adhesive pavement marker of claim 18, wherein the downwardly facing openings are pre-filled with the adhesive after moulding and before the pre-filled adhesive pavement marker is adhered to an adhesive pad on a surface of a pavement.

* * * * *